US011470969B2

(12) United States Patent
Olarte

(10) Patent No.: US 11,470,969 B2
(45) Date of Patent: Oct. 18, 2022

(54) TWO PIECE PLATE LEG SECURING SYSTEM

(71) Applicant: Series International, LLC, Aventura, FL (US)

(72) Inventor: Alvaro Mauricio Olarte, Aventura, FL (US)

(73) Assignee: Series International, LLC, Aventura, FL (US)

( * ) Notice: Subject to any disclaimer, the term of this patent is extended or adjusted under 35 U.S.C. 154(b) by 0 days.

(21) Appl. No.: 17/696,462

(22) Filed: Mar. 16, 2022

(65) Prior Publication Data

US 2022/0295984 A1 Sep. 22, 2022

Related U.S. Application Data

(60) Provisional application No. 63/161,733, filed on Mar. 16, 2021.

(51) Int. Cl.

| | |
|---|---|
| ***A47C 1/124*** | (2006.01) |
| ***A47C 11/00*** | (2006.01) |
| ***A47B 39/02*** | (2006.01) |
| ***A47B 83/02*** | (2006.01) |
| ***A47C 1/12*** | (2006.01) |
| ***A47C 13/00*** | (2006.01) |
| *A47B 41/00* | (2006.01) |

(52) U.S. Cl.

CPC ..... *A47C 1/124* (2013.01); *A47B 39/023* (2017.08); *A47B 83/02* (2013.01); *A47C 1/12* (2013.01); *A47C 11/005* (2013.01); *A47C 13/005* (2013.01); *A47B 41/00* (2013.01); *A47B 2230/15* (2013.01)

(58) Field of Classification Search

CPC .. A47C 1/12; A47C 1/124; A47C 4/02; A47C 11/005; A47C 13/005; A47B 2230/15; A47B 2230/16; B61D 33/00

USPC ..... 297/248, 257, 440.15

See application file for complete search history.

(56) References Cited

U.S. PATENT DOCUMENTS

| | | | | |
|---|---|---|---|---|
| 252,533 A * | 1/1882 | Smith | ..... | A47C 5/06 297/301.4 |
| 4,748,913 A * | 6/1988 | Favaretto | ..... | A47B 17/00 108/50.02 |
| 6,746,086 B1 * | 6/2004 | Foster | ..... | A47C 4/03 297/440.14 |

(Continued)

FOREIGN PATENT DOCUMENTS

| | | | | |
|---|---|---|---|---|
| JP | 2019060451 A * | 4/2019 | ..... | A47B 13/02 |
| WO | WO-0016661 A1 * | 3/2000 | ..... | A47C 11/005 |
| WO | WO-2019065589 A1 * | 4/2019 | ..... | A47C 1/124 |

*Primary Examiner* — Robert Canfield

(74) *Attorney, Agent, or Firm* — St. Onge Steward Johnston & Reens LLC

(57) ABSTRACT

A flat plate based system for securing legs to a chair is provided wherein a chair support has two catches and two leg pieces each have a tab at one end, the tab configured to interact with one of the two catches, each leg piece including an opening through which a tension member passes. Anchor pieces are configured to secure to the tension member such that the tension member pulls the anchor pieces together. The leg pieces each have an edge such that the edges face each other and the tabs interact with the catches and the tension member is positioned in the opening and the anchor pieces and tension member pull the edges together to hold the tabs against the two catches.

20 Claims, 7 Drawing Sheets

(56) References Cited

U.S. PATENT DOCUMENTS

| | | | | |
|---|---|---|---|---|
| 7,073,858 | B2 * | 7/2006 | Fisher | A47C 1/121 297/440.22 |
| 9,060,614 | B1 * | 6/2015 | Gibilterra | A47C 3/00 |
| 2014/0232153 | A1 * | 8/2014 | Bell | B64D 11/0649 297/452.1 |
| 2019/0281973 | A1 * | 9/2019 | Coates | F16B 2/22 |

* cited by examiner

TWO PIECE PLATE LEG SECURING SYSTEM

FIELD OF THE INVENTION

The following relates to a system for constructing and securing chair legs. More particularly, the following relates to a chair leg system which is useful for movable chairs or chairs mounted on beams, particularly those chairs used in lecture halls, airports, train stations and other transportation areas and areas of large seated gatherings.

BACKGROUND OF THE INVENTION

A common way to create chair legs for beam based seating involves making an inverted "V" or "U" shaped leg pair which is often made by casting. This is often a very expensive process or a process which does not lend itself to easy modifications of the leg geometry and design. However, chairs are often placed in different space constraints or may need to consider different design parameters for the legs which result in a change to the leg shape being necessary. Given the expensive process of casting metal, re-working the molds/tooling is often not something that can be done in a cost effective way on a regular basis.

Further, in locations where large amounts of seats are needed, savings of a few dollars per chair can multiply very rapidly in a situation where thousands of seats are required. At the same time, many chairs are used in places where durability is very important in that the chairs are used by many different people in public spaces and therefore take more punishment than chairs found in the home. However, it should be understood that the invention herein is not limited to being useful in chairs used in public spaces.

Therefore, the prior art fails to provide a chair leg and leg securing system with is both durable and cost effective.

SUMMARY OF THE INVENTION

It is therefore an object of the invention to provide a chair leg construction which can be manufactured from flat plate and to provide a securing system that allows for connection between extruded beams and the chair leg system.

It is further desirable to provide a chair which allows for accessory power to be wired inside hollow spaces of the beam or chair support.

These and other objects are achieved by providing a system for securing legs to a chair. The system includes a chair support having two catches and two leg pieces each having a tab at one end, the tab configured to interact with one of the two catches, each leg piece including an opening through which a tension member passes. Anchor pieces are configured to secure to the tension member such that the tension member pulls the anchor pieces together and the leg pieces each have an edge such that the edges face each other and the tabs interact with the catches and the tension member is positioned in the opening and the anchor pieces and tension member pull the edges together to hold the tabs against the two catches.

In certain aspects a pair of backing plates are provided with each having an opening configured to receive one of the anchor pieces and an edge such that the edges of the backing plates face each other when the backing plates are positioned adjacent the two leg pieces and the pair of backing plates includes material adjacent the tension member which blocks lateral movement of the tension member in a direction transverse an elongated axis of the tension member. In other aspects two pairs of backing plates are provided and the pairs are installed on opposite faces of the two leg pieces such that the opening in each leg piece and the material adjacent the tension member of the two pairs of backing plates creates a closed space in which the tension member sits. In certain aspects the anchor pieces include one anchor piece with a through hole and another anchor piece with a threaded through hole.

In still further aspects the two leg pieces are cut from flat plate. In other aspects the anchor pieces are cut from flat plate. In still other aspects the two leg pieces, and the two pairs of backing plates are cut from flat plate. In certain aspects the leg pieces have a rectangular cross section in a plane perpendicular a longitudinal axis of the tension member. In certain aspects the tension member is a bolt.

In other aspects the two catches include outward facing angled surfaces and each tab includes an inward facing angled surface. In other aspects each tab includes an outward facing angled surface at a different angle than that of the inward facing angled surface. In still other aspects the two catches are contained in a channel having two surfaces which face each other, the outward facing angled surface being one of the two surfaces which face each other and an inward facing angled surface being a second one of the two surfaces which face each other, the inward facing angled surface of the channel being at a different angle than that of the outward facing angled surface of the channel. In yet other aspects the inward facing angled surface of the channel is at a more vertical angle than that of the outward facing angled surface of the channel. In still other aspects the chair support is an extrusion extending along an axis perpendicular to an elongated axis of the tension member. In yet other aspects the catches are spaced apart such that and the tabs are spaced from the two edges of the two leg pieces such that the two edges are spaced apart when the tension member is under tension.

In yet other aspects the chair support is an elongated beam with two more seats mounted to a top side thereof and wherein the leg pieces are secured to a bottom side of the beam and extend downwardly and outwardly.

In certain aspects, the leg members include portions which are mirror images of each other. In other aspects the entirety of the leg members are mirror images of each other. In certain aspects, the upper ⅔, the upper half or the upper 25% of the leg members are mirror images of each other. In certain aspects, the outward and downward angle of one leg member is different than the outward and downward angle of another leg member.

Other objects are achieved by providing a system for securing legs to a chair comprising a chair support which is elongated and has two catches. Two leg pieces each have a tab at one end and the tab is configured to interact with one of the two catches. Each leg piece includes an opening through which a tension member passes. An anchor piece is configured to secure to the tension member such that the tension member pulls the anchor piece. The tension member is configured to be positioned in the opening of the two leg pieces with the openings aligned such that the tension member pulls the two leg pieces together to hold the tabs against the two catches to thereby secure the two leg pieces to the chair support.

In some aspects the anchor piece includes a plurality of anchor pieces and a pair of backing plates each have an opening configured to receive one of the anchor pieces. The backing plates are positioned adjacent the two leg pieces. In other aspects the pair of backing plates include material adjacent the tension member which blocks lateral movement of the tension member in a direction transverse an elongated axis of the tension member. The backing plates interact with the anchors such that the tension member pulls the backing plates together. The backing plates each include a tab which interacts with the catches to hold the backing plates to the chair support. In other aspects the two leg pieces have two edges which face each other to define a first seam and the pair of backing plates have two edges which face each other to define a second seam and the first and second seams are arranged so that at least a portion of one of the backing plates is positioned to overlap at least part of the first seam.

In other aspects the pair of backing places comprises two pairs of backing plates with each pair installed adjacent opposite faces of the two leg pieces such that the opening in each leg piece and material of the backing plate adjacent the tension member of the two pairs of backing plates creates a closed space in which a portion of the tension member sits.

In other aspects the anchor pieces include a plurality of anchor pieces, one anchor piece with a through hole and another anchor piece with a threaded through hole. In still other aspects the two leg pieces, and the two pairs of backing plates are cut from flat plate. In yet other aspects each leg piece comprises a single piece having both the tab and a base portion positioned at a second end opposite the end with the tab. In yet other aspects a pad is attached to the base portion which is larger in surface area than the base portion.

In yet other aspects the two catches include outward facing angled surfaces and each tab includes an inward facing angled surface. In still other aspects the chair support is an extrusion extending along an axis perpendicular to an elongated axis of the tension member. In still other aspects the catches are spaced apart such that, and the tabs are spaced from the two edges of the two leg pieces such that, facing surfaces of the two leg pieces are spaced apart when the tension member is under tension. In yet further aspects the chair support is an elongated beam with two more seats mounted to a top side thereof and wherein the leg pieces are secured to a bottom side of the beam and extend downwardly and outwardly and are positionable at any position along the beam without interference with the two or more seats.

Other objects are achieved by providing a chair comprising a chair support having two catches defining outwards facing surfaces. Two leg pieces each have a securing feature at one end defining an inwards facing surface, the securing feature configured to interact with one of the two catches, each leg piece including an opening through which a tension member passes. An anchor piece is configured to secure to the tension member such that the tension member pulls the anchor piece. The tension member is positioned in the opening and the anchor piece and tension member pull the inwards facing surfaces of each leg together to exert pressure on the outwards facing surfaces of the chair support with the catches resisting the securing features being pulled together to thereby secure the leg pieces to the chair support.

In certain aspects the chair support comprises an upper catch with a chair secured thereto, the chair having a seating surface and secured to the upper catch with a chair securing member. The outwards facing surfaces are positioned on a bottom of the chair support and the legs extend downwardly with respect to the chair support and the legs and the catch are configured such that the legs can be secured at any position along an elongated length of the beam without interference with the chair securing member. In other aspects the leg pieces are secured to the chair support without needing securing members which pass through through-holes in the chair support. In other aspects the inwards facing surfaces and the outwards facing surfaces are each angled.

Other objects are achieved by providing a chair having a chair support having two catches and two leg pieces each having a securing feature at one end. The securing feature is configured to interact with one of the two catches wherein each leg piece is made from flat plate materials such that each leg is comprised of a first set of substantially parallel surfaces and a second set of surfaces arranged at approximately 90 degrees to the first set of substantially parallel surfaces which cause the leg to have a rectilinear cross section. A tension member pulls the two leg pieces together to pull the securing features together with the catches resisting the securing features being pulled together to thereby secure the leg pieces to the chair support such that each leg extends downwards and outwards with respect to the chair support and outwards with respect to the other of the two leg pieces.

In certain aspects each leg piece comprises a single piece having both the tab and a base portion positioned at a second end opposite the end with the tab. In other aspects a plurality of anchor pieces are pulled together by the tension member and a pair of backing plates each have an opening configured to receive one of the anchor pieces wherein the backing plates are positioned adjacent the two leg pieces. The pair of backing plates includes material adjacent the tension member which blocks lateral movement of the tension member in a direction transverse an elongated axis of the tension member. The backing plates interact with the anchors such that the tension member pulls the backing plates together. The backing plates each include a securing feature which interacts with the catches to hold the backing plates to the chair support.

Other objects of the invention and its particular features and advantages will become more apparent from consideration of the following drawings, claims and accompanying detailed description.

DETAILED DESCRIPTION OF THE INVENTION

Figure 2:
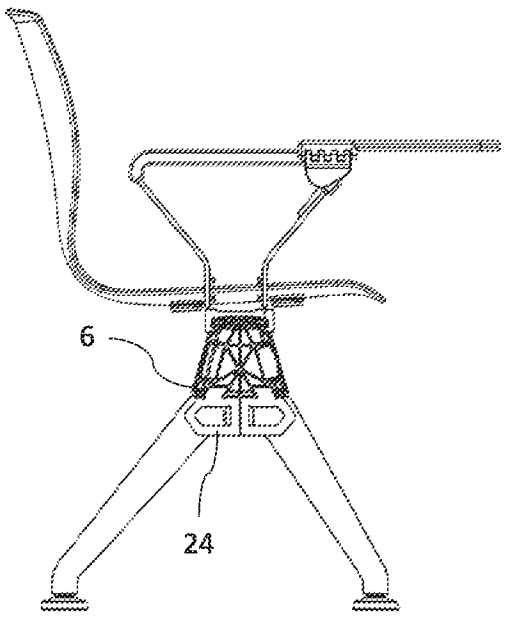
FIG. 2 is a side view of FIG. 1 with a side cover removed.

Referring now to the drawings, wherein like reference numerals designate corresponding structure throughout the views. The following examples are presented to further illustrate and explain the present invention and should not be taken as limiting in any regard.

Figure 1A:
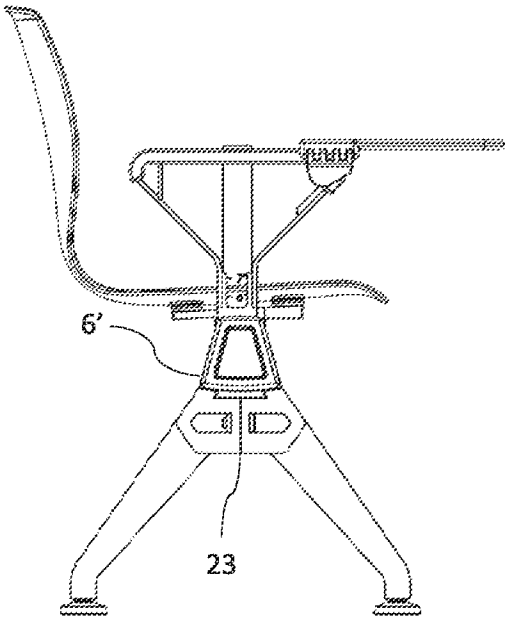
FIG. 1A is a side view of another chair according to the present invention
Figure 1:
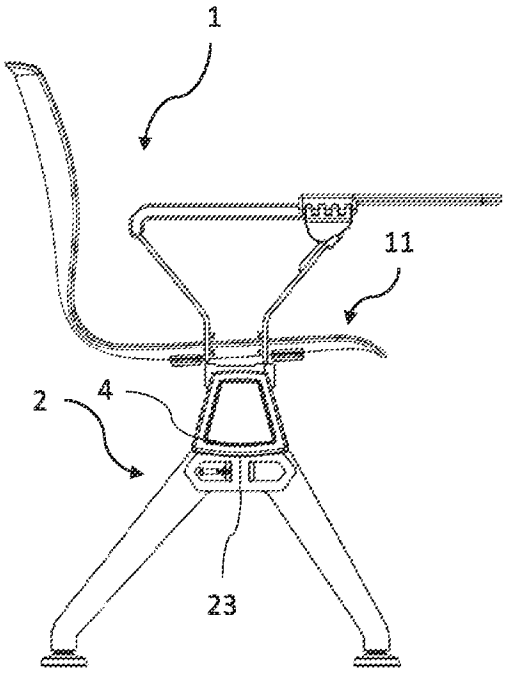
FIG. 1 is a side view of a chair according to the present invention.
Figure 3A:
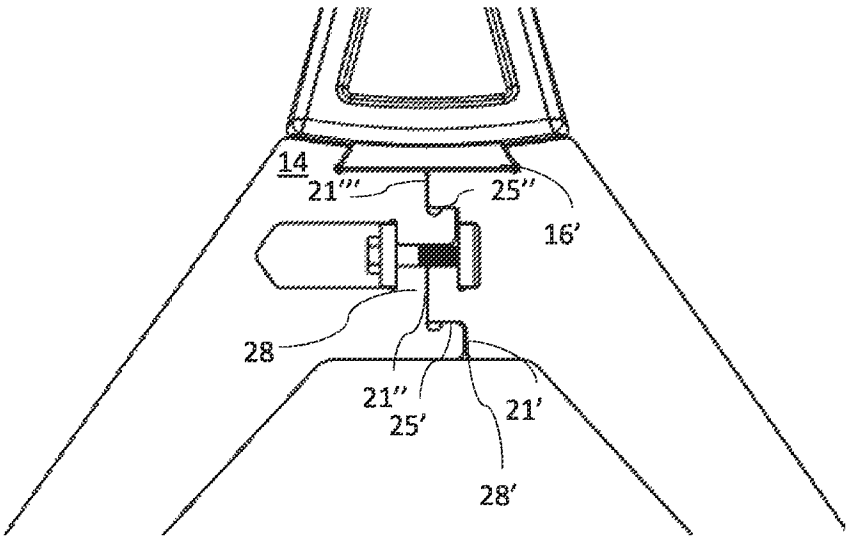
FIG. 3A another detail view with parts removed to show an alternative leg embodiment of FIG. 1A
Figure 3:
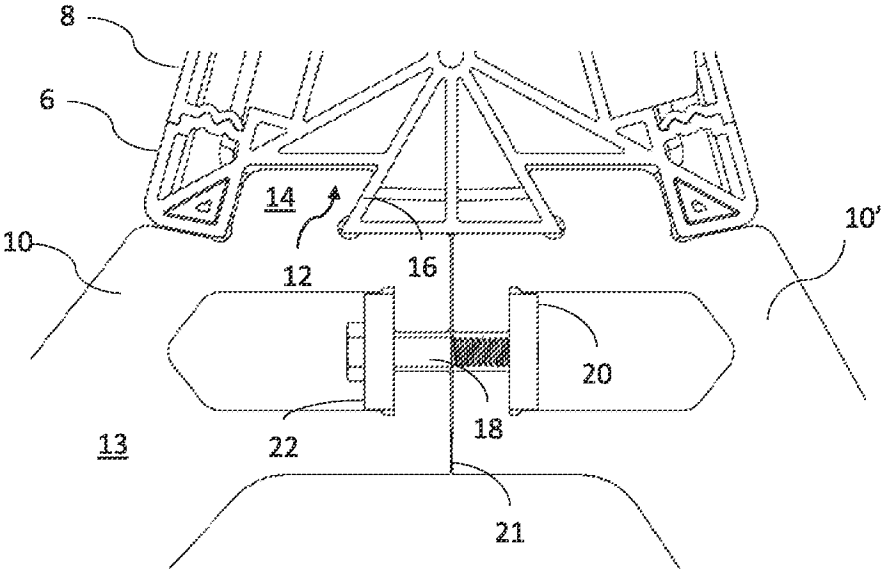
FIG. 3 is a detail view of FIG. 2 with additional parts removed.

The chair is shown in FIG. 1 with an exemplary the leg support assembly 2 according to the present invention. FIG. 2 shows the end cover 4 removed from the beam or chair support 6 to depict how the leg assembly 2 secures to the beam 6. Referring to FIG. 3, the backing plates 24 have been removed relative to FIG. 2 and detail on the leg pieces 10/10' are shown. Piece 10 is substantially the mirror image of piece 10'. A similar convention is used for other parts which are mirror images of each other (e.g. 14/14'). As can be seen the upper portion of the leg piece 10 includes a tab 14 which fits in beam channel 12. The outward facing angled surface 16 of the channel 16 interacts with tab 14 and its correspondingly angled inwardly facing edge/surface which is part of the leg 10. As can be seen, the inwardly facing edge/surface which mates to surface 16 of the beam is at a more shallow angle as compared to surface/edge 30 which is outwardly facing and faces the inwardly facing surface of the beam channel 12. Although it may be difficult to see in the drawing, there is typically a small space between surface/edge 30 and its facing surface of the beam whereas surface 16 of the beam contacts the associated angled surface of the tab 14. The different angles of the tab/beam channel allow for the tab to be easily inserted into the channel from the bottom of the beam rather than requiring sliding the leg piece 10 in from the ends. As a result of the bolt and anchor plates pulling the leg pieces together, edges 28/28' are preferably brought into contact or have a very small gap. The similarly located edges of backing plates 24/24' are also brought into contact (or provided with a small gap) when the bolt 18 is tightened. In some embodiments, a nut may be welded or otherwise secured to anchor 20, but in preferred embodiments, a tapped hole is provided in anchor 20.

Figure 4:
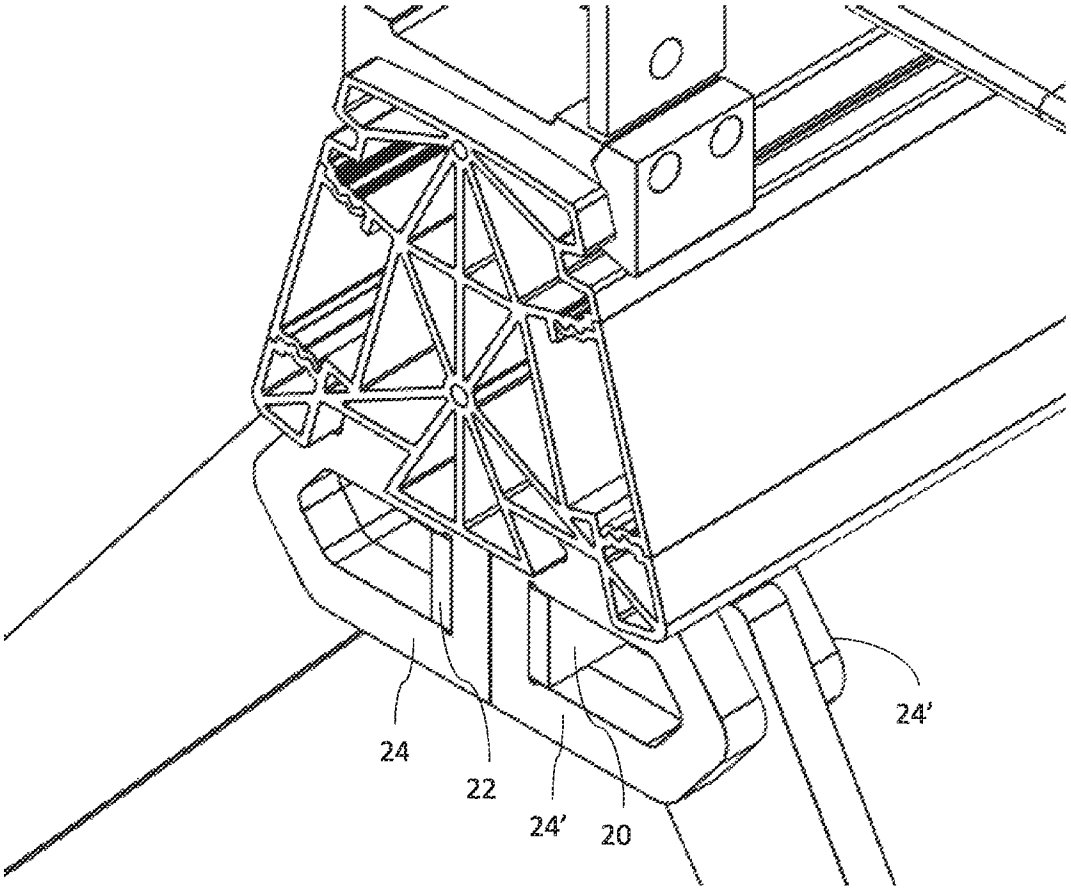
FIG. 4 is a perspective view of FIG. 2.
Figure 6:
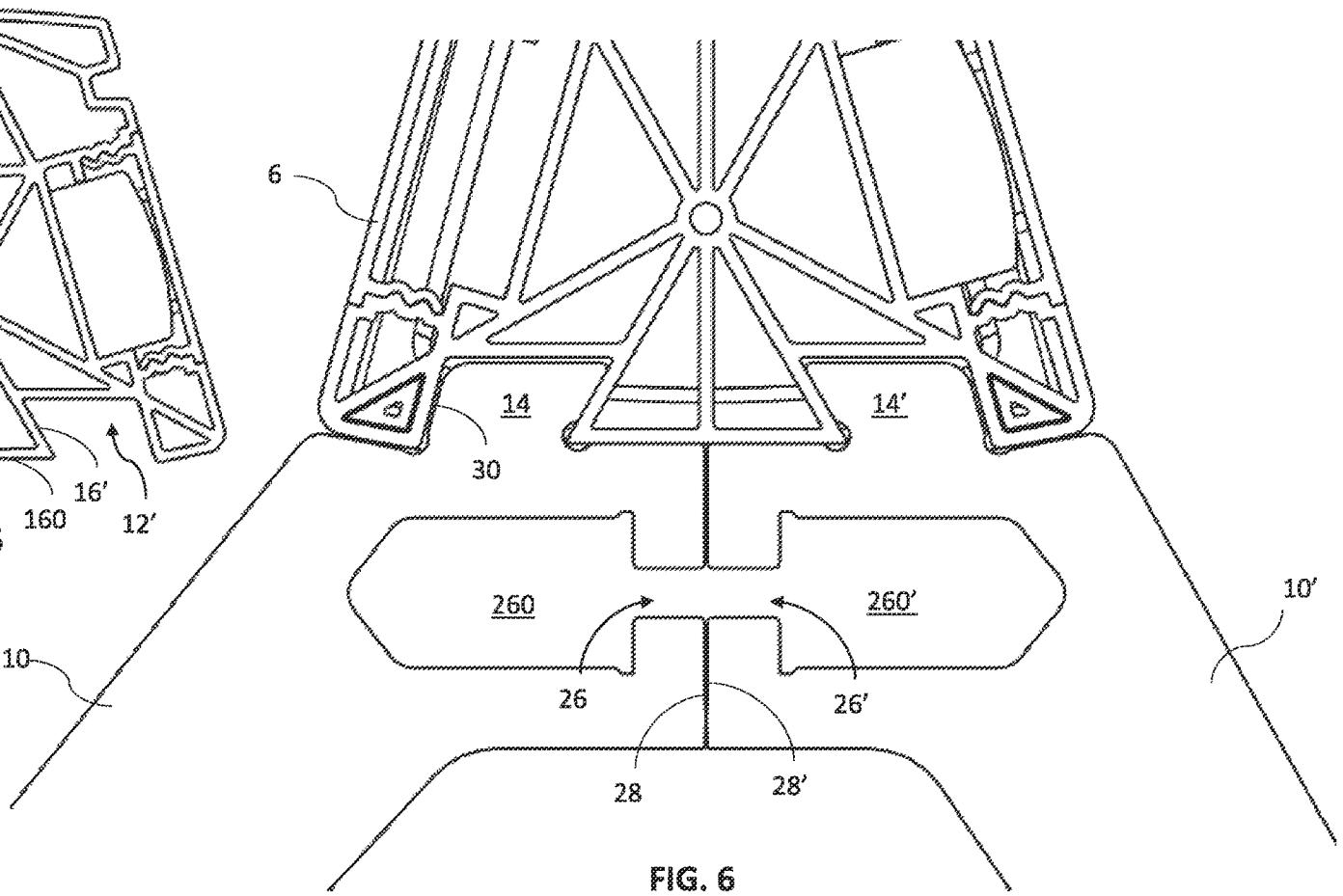
FIG. 6 is a detail view of FIG. 2 with additional parts removed as compared to FIG. 3.

These edges 28/28' along with the other edges of the leg pieces are all created by two dimensional cutting of a flat plate material, such that the edges are a small flat strip of the plate material. Therefore, the major surfaces of the leg pieces create two parallel surfaces as a result of being made from the flat plate material and the edges (e.g. 28/28') are arranged at about 90 degrees to those surfaces. The angle might not be perfectly 90 degrees or the surfaces might not be perfectly parallel and one of skill in the art would understand that this distinction allows for variances due to tolerances in manufacturing depending on the techniques used. As also shown, the location where the edges 28/28' abut provides a seam which may be an small actual gap or the two edges abutting. The backing plates 24/24' as shown in e.g. FIG. 4 also have a similar seam which generally aligns with the seam created by the two leg pieces. However, FIG. 3A shows another arrangement of the leg pieces where the edges 28/28' are positioned differently than the seam of the backing plates, with multiple segments (e.g. 21',21"21,'", 25' and 25"). As a result, there is overlap of the backing plate seam with the leg piece seam.

The combination of the backing plates 24/24' and the leg pieces with their openings 26/26' creates an enclosed through hole through which the bolt 18 passes. This enclosed through hole is generally rectangular or optimally square in cross section. This creates a closed space for the bolt 18 such that the bolt will not move laterally (i.e. along the longitudinal axis of the beam).

Figure 5:
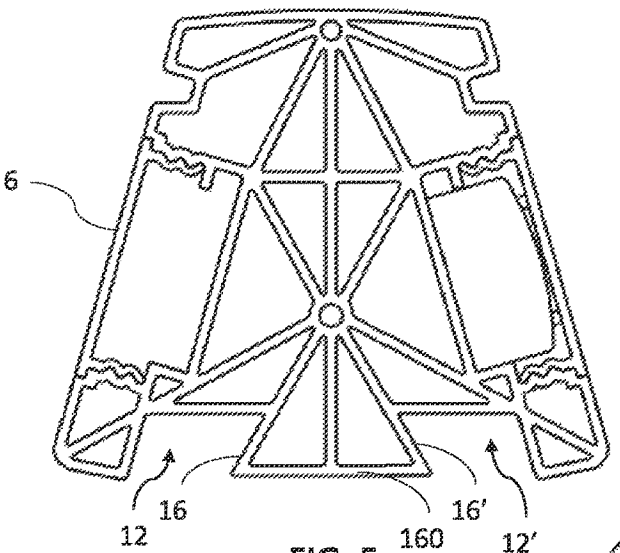
FIG. 5 is a side view of the beam in FIG. 1.
Figure 7:
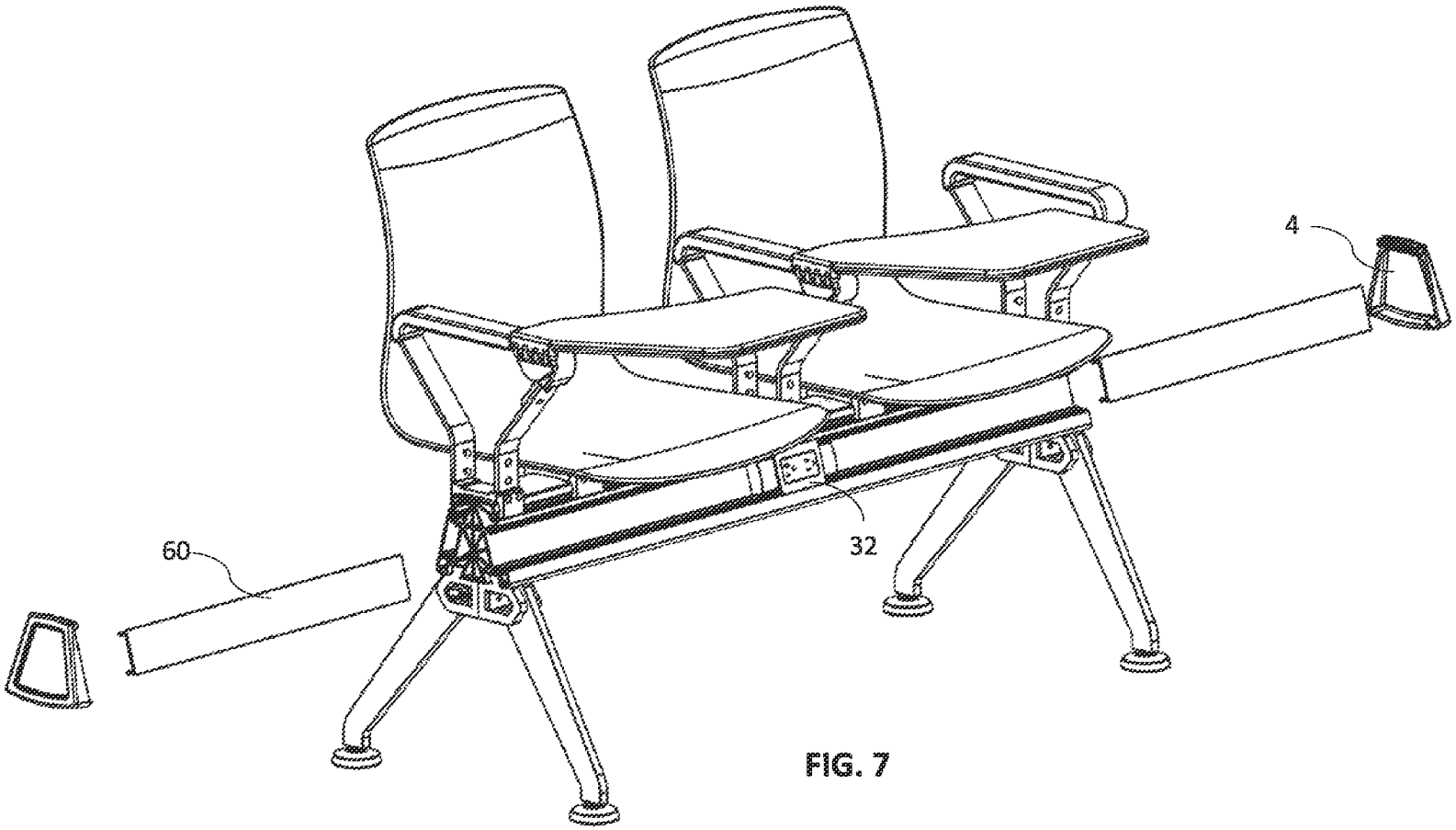
FIG. 7 is an exploded perspective view of FIG. 1.

FIG. 1A provides a similar chair in many respects, but the beam design is slightly different in that channels 12 (FIG. 5) are of a different configuration without the outer portion. FIG. 3A provides further detail and as shown the tabs 14 extend to be approximately flush with the lower and outer edge of the beam and the angled surface 16' is still provided to engage the tabs 14 in a similar manner.

Figure 11:
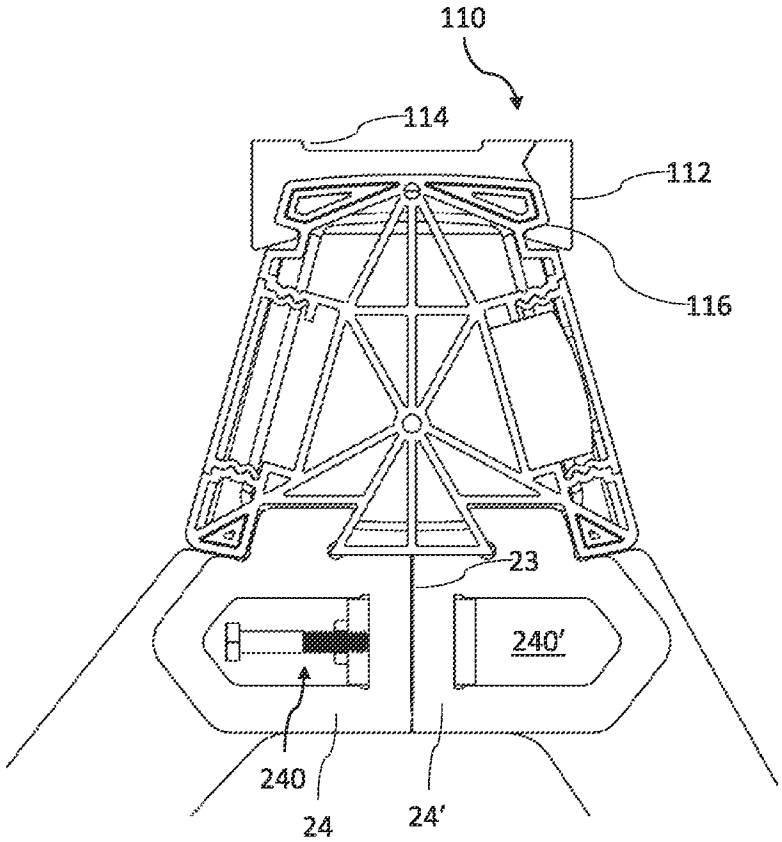
FIG. 11 is a side detail view of the chair of FIG. 1 with a side cover removed.

As can be seen in FIGS. 3-6, tension member 18 is shown as a bolt which is elongated and has an elongated axis down the center of the cylinder. Anchor pieces 22/20 are secured with the bolt 18 in that anchor piece 22 has a through hole and piece 20 has a threaded through hole. By tightening bolt 18, the tabs 14/14' are pulled together against nub 160 of the beam and its corresponding surfaces 16/16'. The anchor pieces 20/22 are long enough to also pull together backing plates 24/24' which are generally shaped the same as the upper portions of the leg pieces 10/10' but that no opening 26/26' is provided and as shown in FIG. 11, the plates 24/24' do not extend down to the floor like the legs 10/10' do. Opening 240' (and the corresponding opening 26' and opening 260' of the leg piece 10' receive the anchor plate 20 and the openings on the other leg 10 and plate 24 receive the other anchor plate 22. It is understood that this configuration/location of the anchor plates 20/22 can be reversed.

The addition of the backing plates 24/24' (on one or both sides of leg 10/10') provide added stability to the overall leg in that a wider surface contacts the beam to inhibit the beam from moving back and forth along its longitudinal axis due to the leg securing system having insufficient contact width. This can also be accomplished in some cases by a wider leg 10/10'. As can also be seen all of the openings 26/26' 260/260' and 240/240' are through openings in that those openings can be machined using two dimensional cutting tools. Optimally, laser cutting or water jet cutting are utilized so that the parts herein described can be cut from a larger flat plate. Additionally, since the leg assembly 2 is made with the largest two pieces 10/10' being mirror images and separable in the middle, manufacturing allows less material waste during water jet/laser cutting in that the leg cutouts can be laid out with many stacked and almost concentric leg pieces rather than requiring a larger gap in locations at the top of the inverted V/U which would result in more material waste.

Figure 9:
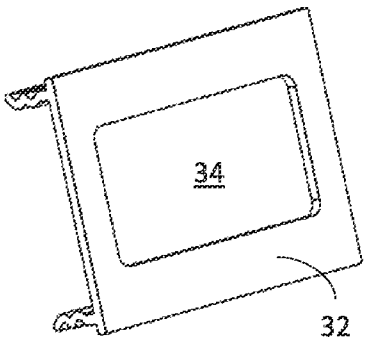
FIG. 9 is a perspective view of a component FIGS. 1 and 8.
Figure 10:
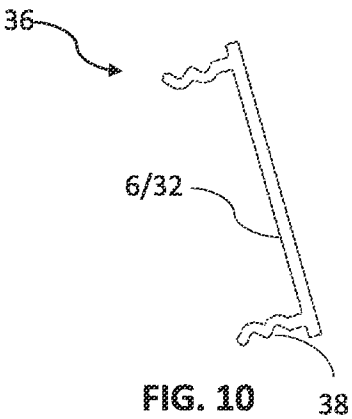
FIG. 10 is a side view of components of FIGS. 1 and 8.
Figure 8:
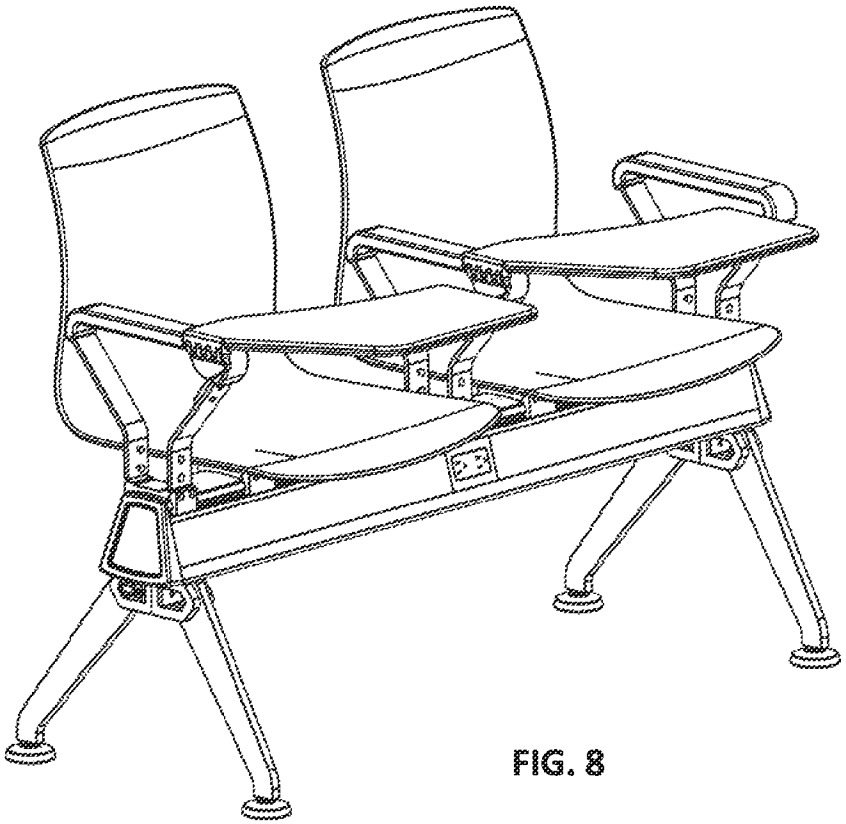
FIG. 8 is a perspective view of FIG. 1.

The beam is also provided with front and rear channels which can receive covers 60 and optionally outlet plates 32. The cross section of the cover 60 and outlet plate 32 is identical as shown in FIG. 10. Namely, fingers 36 are provided with undulations 38 (two shown) which mate with cooperatively shaped undulations in the front and rear beam channels. This allows the plate 32 and/or cover 60 to be snapped in from the front in that these pieces are in some embodiments made from extruded plastics or other flexible materials such that the fingers 36 can flex slightly to allow insertion from the front. Alternately, insertion from the side can be accomplished by sliding the covers 6 out and also removing end cover 4. With these covers 60, wiring can be installed inside the beam such that the wiring fits in the beam channel which receives the covers 60 and outlet plate 32. As shown in FIG. 9, the outlet plate is provided with opening 34 which receives a conventionally shaped outlet. As would be apparent to those skilled in the art, the opening 34 can be modified to fit any commercially available power outlet. The covers can be installed/removed without interference from the chair/chair securing member or interference from the legs.

The seam 21 in FIG. 3 between the leg pieces where the edges thereof face each other is also aligned with seam 23 (FIG. 11). FIG. 3A shows an alternative leg interface/seam configuration where the seam includes a number of segments which are vertical 21', 21", 21'" along with horizontal portions 25' and 25". As shown, vertical seam portions 21"

and 21''' are generally centered relative to the beam. Two other vertical portions 21 (other not numbered) are offset relative to center. As a result, portions of one leg overlap seam 23 or the backing plates which may provide further stability to the leg design, especially with lateral loading (i.e. along the beam direction or across the seat).

The chair 1 including the seating surface 11 is secured to the upper side of the beam. Also shown in FIG. 1 are armrests secured to the beam. As shown in FIG. 11, a securing member 110 is provided from parts 114 and 112 which are pulled together by a bolt to grab the upper catch 116 of the chair support beam. The securing member 110 may be a chair securing member or armrest securing member or may be configured to secure something else to the beam. The securing member includes hooks or generally upwards facing surfaces which interact with downwards facing surfaces that define the upper catch 116. In this manner, the securing member does not require through holes through the chair support/beam in order to secure to the beam. Similarly, the legs do not require through holes through the chair support/beam in order to secure to the beam. As shown both the securing member for the chair/armrests etc. on the top of the beam and the legs as secured to the bottom of the beam do not interfere with each other or other components of the chair assembly in that the same can be placed at any position along the length of the beam. Furthermore, neither the legs nor the chair securing member require insertion from an end of the beam, thus the assembly process does not require insertion of components into channels of the beam from the end of the beam in order to allow the legs and/or chair securing members to hold to the beam. Rather, the securing features shown and described herein are external clamp features which can be inserted and clamped without the need for any lateral sliding (i.e. along the length of the beam).

The legs and the backing plates are shown as being made from flat plate material. This allows for 2d cutting tools such as water jet and laser cutting, for example, to be used in the manufacturing process. As a result, the flat plate has two parallel surfaces 13 (and the surface on the opposite side) and then the edges are generally at about 90 degrees to those surfaces 13. As a result, a cross section taken at a majority of locations along the length of the leg is rectilinear, as shown the rectilinear cross section exists at more than 75% of the positions along the leg piece lengths (e.g. a horizontal cross section with the length/position measured vertically).

Although the invention has been described with reference to a particular arrangement of parts, features and the like, these are not intended to exhaust all possible arrangements or features, and indeed many other modifications and variations will be ascertainable to those of skill in the art.

What is claimed is:

1. A system for securing legs to a chair comprising:

a chair support which is elongated and has two catches;

two leg pieces each having a tab at one end, the tab configured to interact with one of the two catches, each leg piece including an opening through which a tension member passes;

an anchor piece which is configured to secure to the tension member such that the tension member pulls the anchor piece;

the tension member configured to be positioned in the opening of the two leg pieces with the openings aligned such that the tension member pulls the two leg pieces together to hold the tabs against the two catches to thereby secure the two leg pieces to the chair support.

2. The system of claim 1 further comprising:

the anchor piece comprises a plurality of anchor pieces;

a pair of backing plates each having an opening configured to receive one of the anchor pieces wherein the backing plates are positioned adjacent the two leg pieces.

3. The system of claim 2 wherein:

the pair of backing plates includes material adjacent the tension member which blocks lateral movement of the tension member in a direction transverse an elongated axis of the tension member;

the backing plates interact with the anchors such that the tension member pulls the backing plates together; and the backing plates each include a tab which interacts with the catches to hold the backing plates to the chair support.

4. The system of claim 2 wherein two leg pieces have two edges which face each other to define a first seam wherein the pair of backing plates have two edges which face each other to define a second seam and the first and second seams are arranged so that at least a portion of one of the backing plates is positioned to overlap at least part of the first seam.

5. The system of claim 2 wherein the pair of backing places comprises two pairs of backing plates with each pair installed adjacent opposite faces of the two leg pieces such that the opening in each leg piece and material of the backing plate adjacent the tension member of the two pairs of backing plates creates a closed space in which a portion of the tension member sits.

6. The system of claim 1 wherein the anchor pieces include a plurality of anchor pieces, one anchor piece with a through hole and another anchor piece with a threaded through hole.

7. The system of claim 5 wherein the two leg pieces, and the two pairs of backing plates are cut from flat plate.

8. The system of claim 1 wherein each leg piece comprises a single piece having both the tab and a base portion positioned at a second end opposite the end with the tab.

9. The system of claim 1 further comprising a pad attached to a base portion of at least one of the two leg pieces, the pad is larger in surface area than the base portion.

10. The system of claim 1 wherein the two catches include outward facing angled surfaces and each tab includes an inward facing angled surface.

11. The system of claim 1 wherein the chair support is an extrusion extending along an axis perpendicular to an elongated axis of the tension member.

12. The system of claim 1 wherein the catches are spaced apart such that, and the tabs are spaced from the two edges of the two leg pieces such that, facing surfaces of the two leg pieces are spaced apart when the tension member is under tension.

13. The system of claim 1 wherein the chair support is an elongated beam with two or more seats mounted to a top side thereof and wherein the leg pieces are secured to a bottom side of the beam and extend downwardly and outwardly and are positionable at any position along the beam without interference with the two or more seats.

14. A chair comprising:

a chair support having two catches defining outwards facing surfaces;

two leg pieces each having a securing feature at one end defining an inwards facing surface, the securing feature configured to interact with one of the two catches, each leg piece including an opening through which a tension member passes;

an anchor piece configured to secure to the tension member such that the tension member pulls the anchor piece;

the tension member is positioned in the opening and the anchor piece and tension member pull the inwards facing surfaces of each leg together to exert pressure on the outwards facing surfaces of the chair support with the catches resisting the securing features being pulled together to thereby secure the leg pieces to the chair support.

15. The chair of claim 14 further wherein:

the chair support comprises an upper catch with a chair secured thereto, the chair having a seating surface and secured to the upper catch with a chair securing member; and wherein the outwards facing surfaces are positioned on a bottom of the chair support and the legs extend downwardly with respect to the chair support and the legs and the catch are configured such that the legs can be secured at any position along an elongated length of the chair support without interference with the chair securing member.

16. The chair of claim 14 wherein the leg pieces are secured to the chair support without needing securing members which pass through through-holes in the chair support.

17. The chair of claim 14 wherein the inwards facing surfaces and the outwards facing surfaces are each angled.

18. A chair comprising:

a chair support having two catches;

two leg pieces each having a securing feature at one end, the securing feature configured to interact with one of the two catches wherein each leg piece is made from flat plate materials such that each leg is comprised of a first set of substantially parallel surfaces and a second set of surfaces arranged at approximately 90 degrees to the first set of substantially parallel surfaces which cause the leg to have a rectilinear cross section;

a tension member which pulls the two leg pieces together to pull the securing features together with the catches resisting the securing features being pulled together to thereby secure the leg pieces to the chair support such that each leg extends downwards and outwards with respect to the chair support and outwards with respect to the other of the two leg pieces.

19. The chair of claim 18 wherein each leg piece comprises a single piece having both the securing feature and a base portion positioned at a second end opposite the end with the securing feature.

20. The chair of claim 18 further comprising:

a plurality of anchor pieces which are pulled together by the tension member;

a pair of backing plates each having an opening configured to receive one of the anchor pieces wherein the backing plates are positioned adjacent the two leg pieces the pair of backing plates includes material adjacent the tension member which blocks lateral movement of the tension member in a direction transverse an elongated axis of the tension member;

the backing plates interact with the anchors such that the tension member pulls the backing plates together; and the backing plates each include a securing feature which interacts with the catches to hold the backing plates to the chair support.

* * * * *